US010987689B1

(12) United States Patent
Zhang

(10) Patent No.: US 10,987,689 B1
(45) Date of Patent: Apr. 27, 2021

(54) BOTTLE AND BOTTLE CAP DEVICE THEREOF

(71) Applicant: Zhejiang Yuejia Pharmaceuticals Co., Ltd, Deqing County (CN)

(72) Inventor: Jing Zhang, Shanghai (CN)

(73) Assignee: Zhejiang Yuejia Pharmaceuticals Co., Ltd, Deqing County (CN)

( * ) Notice: Subject to any disclaimer, the term of this patent is extended or adjusted under 35 U.S.C. 154(b) by 0 days.

(21) Appl. No.: 16/902,354

(22) Filed: Jun. 16, 2020

(30) Foreign Application Priority Data

Oct. 11, 2019 (CN) ..... 201921694372.3

(51) Int. Cl.

| | |
|---|---|
| ***B05B 11/00*** | (2006.01) |
| ***B65D 51/28*** | (2006.01) |
| ***B65D 41/02*** | (2006.01) |
| ***B05B 15/30*** | (2018.01) |

(52) U.S. Cl.
CPC ..... *B05B 11/3047* (2013.01); *B05B 11/0037* (2013.01); *B05B 11/0081* (2013.01); *B05B 15/30* (2018.02); *B65D 41/023* (2013.01); *B65D 51/2828* (2013.01); *B65D 2251/205* (2013.01)

(58) Field of Classification Search
CPC ..... B05B 11/3047; B05B 11/0081; B05B 11/0037; B05B 15/30; B65D 41/023; B65D 51/2828; B65D 2251/205
USPC ..... 222/383.1, 83, 136, 321.6–321.9; 206/219, 222; 220/521–523; 215/227
See application file for complete search history.

(56) References Cited

U.S. PATENT DOCUMENTS

| | | | | |
|---|---|---|---|---|
| 4,793,475 | A * | 12/1988 | Itzel | B65D 81/3222 206/221 |
| 6,412,659 | B1 * | 7/2002 | Kneer | B05B 11/3047 222/82 |
| 8,152,008 | B2 * | 4/2012 | Cho | B05B 11/0083 215/227 |
| 8,267,280 | B2 * | 9/2012 | Kneer | B05B 15/30 222/83 |
| 8,403,131 | B2 * | 3/2013 | Rovelli | B65D 51/2835 206/222 |
| 8,794,474 | B2 * | 8/2014 | Mueller | B05B 11/0081 220/521 |
| 9,211,984 | B2 * | 12/2015 | Dyrbye | B65D 51/2864 |
| 9,776,198 | B2 | 10/2017 | Scherer | |
| 10,092,921 | B2 * | 10/2018 | Muller | A45D 34/00 |

(Continued)

*Primary Examiner* — Lien M Ngo
(74) *Attorney, Agent, or Firm* — Christopher & Weisberg, P.A.

(57) ABSTRACT

A bottle and a bottle cap device thereof are provided. In the bottle cap device, the outer-cap outer ring is threadedly connected with the inner-cap outer ring, the outer-cap inner ring penetrates through the inner-cap inner ring, the lower end of the outer-cap inner ring protrudes for a distance from the inner-cap inner ring, and the guide tube is arranged to extend in the outer-cap inner ring. The distance is sufficient to allow the end cap to be connected with the lower end of the outer-cap inner ring in a releasably sealing manner, and when the outer-cap outer ring is turned toward the loosening direction, the distance is sufficiently shortened to allow the end cap abutting with the inner-cap inner ring; while the end cap is connected with the inner-cap inner ring, the guide tube is connected with the end-cap hole, such that a stockage space is formed.

10 Claims, 6 Drawing Sheets

(56) References Cited

U.S. PATENT DOCUMENTS

| | | | | |
|---|---|---|---|---|
| 2009/0139882 | A1* | 6/2009 | DeJonge ..... | B65D 51/2892<br>206/219 |
| 2011/0204060 | A1* | 8/2011 | Suzuki ..... | B65D 51/2871<br>220/521 |

* cited by examiner

BOTTLE AND BOTTLE CAP DEVICE THEREOF

CROSS-REFERENCE TO RELATED APPLICATION

This application claims priority to Chinese Patent Application Serial No. 201921694372.3, filed Oct. 11, 2019, entitled BOTTLE AND BOTTLE CAP DEVICE THEREOF the entirety of which is incorporated herein by reference.

FIELD

This disclosure relates to a bottle and a bottle cap device thereof.

BACKGROUND

Some medicaments or solvents are formed by mixing solid and liquid, and it cannot be stable for a long time after dissolving solid in liquid. Therefore, such medicaments or solvents can only be mixed when used, and the solid and liquid are stored separately before use. For example, the solid and liquid are separated in different packages. As an example, the solid is powder packed in a bag, and the liquid is packed in a bottle, and when used, the bag is torn open, and the powder is poured into the bottle, so as to form the required medicament or solvent. As the solid and liquid are stored separately, one kind of demand can be met through two kinds of packaging. Moreover, during unpacking the fixed package and when putting the solid into the liquid, it is very likely that the solid powder will be scattered.

According to U.S. Pat. No. 9,776,198B2, bottles equipped with product dispensing system are known, wherein a first and a second product are stored separately before the first use of the bottle, the products being mixed together in the container of the bottle before the first use, especially upon specific manipulations that are performed by the user.

U.S. Pat. No. 9,776,198B2 further records a system for dispensing a mixture of a first product and a second product, comprising a pump having a pump body intended to be rigidly connected to a bottle which contains a first product. The pump comprises a cover and a sealing ring for mounting it on the neck portion of the bottle. The pump further comprises a piston secured to the push button, so as to be actuated by the user in the translation motion of the pump body between a release position and an actuation position, along a descending dispensing stroke and an ascending suction stroke. The system further comprises an additional container attached to the pump body for containing the second product. The system further comprises an organ for opening the additional container, the organ being coupled with a lower check valve of the piston, so as to open the additional container by the movement of the lower check valve at least during the first actuation of the pump.

The aforementioned systems have limited space for storing the second product, and the space for storing the second product is not highly sealed.

SUMMARY

An object of this disclosure is to provide a bottle, which comprises a bottle cap device, wherein the bottle can store a first product and a second product respectively, and the bottle cap device therein can provide sufficient space to reserve the second product.

The bottle cap device according to this disclosure comprises an inner cap, an outer cap and an end cap. The inner cap therein comprises an inner-cap outer ring and an inner-cap inner ring, a joint connected with a bottle neck being defined between the inner-cap outer ring and the inner-cap inner ring; the outer cap comprises an outer-cap outer ring, an outer-cap inner ring and a guide tube, the outer-cap outer ring being threadedly connected with the inner-cap outer ring, the outer-cap inner ring penetrating through the inner-cap inner ring, a lower end of the outer-cap inner ring protruding for a distance from a lower end of the inner-cap inner ring, and the guide tube being arranged to extend in the outer-cap inner ring, providing a guide passage of liquid pipe; the end cap has an end-cap hole;

wherein, the distance is sufficient to allow the end cap to be connected with the lower end of the inner-cap inner ring in a releasably sealing manner, and when the outer-cap outer ring is turned from the inner-cap outer ring toward a loosening direction, the distance is sufficiently shortened to allow the end cap abutting with the lower end of the inner-cap inner ring, and by means of the thrust formed by the abutting, the end cap is made to release from the lower end of the outer-cap inner ring;

while the end cap is connected with the lower end of the inner-cap inner ring in a releasably sealing manner, the guide tube is connected with the end-cap hole in a sealing manner, such that a stockage space encircling the guide tube is formed inside the outer-cap inner ring.

In one or more embodiments of the bottle cap device, the inner cap further comprises an inner-cap end wall connecting the inner-cap outer ring with the inner-cap inner ring, the inner-cap outer ring encircles the inner-cap inner ring and is spaced apart from the inner-cap inner ring by an inner-cap annular gap, the lower end of the inner-cap inner ring protrudes downward with respect to the inner-cap outer ring, the inner-cap annular gap provides a space for inserting the bottle neck, internal thread for connecting the bottle neck is formed on an inner wall surface of the inner-cap outer ring, and external thread is formed on an outer wall surface of the inner-cap outer ring; internal thread is formed on an inner wall surface of the outer-cap outer ring, so that the outer-cap outer ring is threadedly connected with the outer wall surface of the inner-cap outer ring.

In one or more embodiments of the bottle cap device, the inner-cap inner ring is arranged with at least one circle of sealing convex ring on an outer wall surface corresponding to the inner-cap annular gap, and the sealing convex ring is used to contact with an inner peripheral surface of the bottle neck, to form a sealing structure.

In one or more embodiments of the bottle cap device, the outer cap further comprises an outer-cap end wall connecting the outer-cap outer ring with the outer-cap inner ring, the outer-cap outer ring encircles the outer-cap inner ring and is spaced apart from the outer-cap inner ring by an outer-cap annular gap, the outer-cap annular gap provides a space for inserting the inner-cap outer ring, and the guide tube runs from a perforation of the outer-cap end wall and extends downward.

In one or more embodiments of the bottle cap device, the outer-cap end wall provides a nozzle coupling on a side thereof opposite to the outer-cap outer ring and the outer-cap inner ring;

the bottle cap device further comprises a press-type spray head connected with the nozzle coupling, the press-type spray head has a liquid pipe, and the liquid pipe is guided by the guide tube and penetrates through the guide tube.

In one or more embodiments of the bottle cap device, the outer-cap end wall forms a cone wall around the perforation, and the cone wall is configured to guide the liquid pipe to enter a guide part of the guide tube from the perforation.

In one or more embodiments of the bottle cap device, on a hole wall of the end-cap hole, there are at least one circle of rib, the rib contacts with an outer wall surface of the guide tube, to form a sealing structure.

In one or more embodiments of the bottle cap device, a lower-end nozzle of the guide tube is closed by a sheet, and a fracture line is arranged on the sheet.

In one or more embodiments of the bottle cap device, the inner cap further comprises an inner-cap end wall connecting the inner-cap outer ring and the inner-cap inner ring, the outer cap further comprises an outer-cap end wall connecting the outer-cap outer ring and the outer-cap inner ring, the inner-cap end wall and the outer-cap end wall have opposing end surfaces, at least one of the opposing end surfaces is arranged with at least one circle of sealing convex ring which contacts the other of the opposing end surfaces, to form a sealing structure.

In one or more embodiments of the bottle cap device, at least one of opposing wall surfaces between the inner-cap inner ring and the outer-cap inner ring is arranged with at least one circle of sealing convex ring which contacts the other of the opposing wall surfaces, to form a sealing structure.

In one or more embodiments of the bottle cap device, the end cap has an end-cap outer peripheral wall, one, of an inner wall surface of the end-cap outer peripheral wall and a lower-end outer wall surface of the outer-cap inner ring, is formed with an annular rib, while the other is formed with an annular groove, and the end cap is releasably connected at a lower end of the outer-cap inner ring by means of buckling of the annular rib and the annular groove, and the annular rib is mated with the annular groove, to form a sealing structure.

In one or more embodiments of the bottle cap device, a gap is formed between a lower end surface of the inner-cap inner ring and an upper end surface of the end-cap outer peripheral wall of the end cap.

In one or more embodiments of the bottle cap device, an outer-cap baffle ring is arranged on an inner wall of the outer-cap outer ring, and an inner-cap baffle ring is arranged on an outer wall surface of the inner-cap outer ring, and when threaded connection is completely loosened, the inner-cap baffle ring is used to provide a blocking function to movement of the outer-cap baffle ring.

A bottle according to this disclosure comprises a bottle cap device and a bottle body, the bottle cap device is connected with a bottle neck of the bottle body, the bottle body stores a first product, and the bottle cap device stores a second product, wherein the bottle cap device is any one bottle cap device as described before.

When the end cap is released from the lower end of the outer-cap inner ring, the end cap falls into the bottle body, and then the second product is also put into the bottle body to mix with the first product in the bottle body. The stockage space has no relation with the size of the pump body for conveying the mixed product, but can be designed according to the size of the space required for the second product. By turning the outer cap, the bottle cap device can be opened to enable the second product to be put into the bottle body. The opening operation can be carried out by means of turning, and this operation way is simple and natural. Through sealing of the outer-cap inner ring and the end cap, and sealing of the end cap and the guide tube, the sealing preservation of the second product can be realized. Even the first product may move to the position of the end cap during transportation, mixing of the first product and the second product at unexpected times will not occur.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
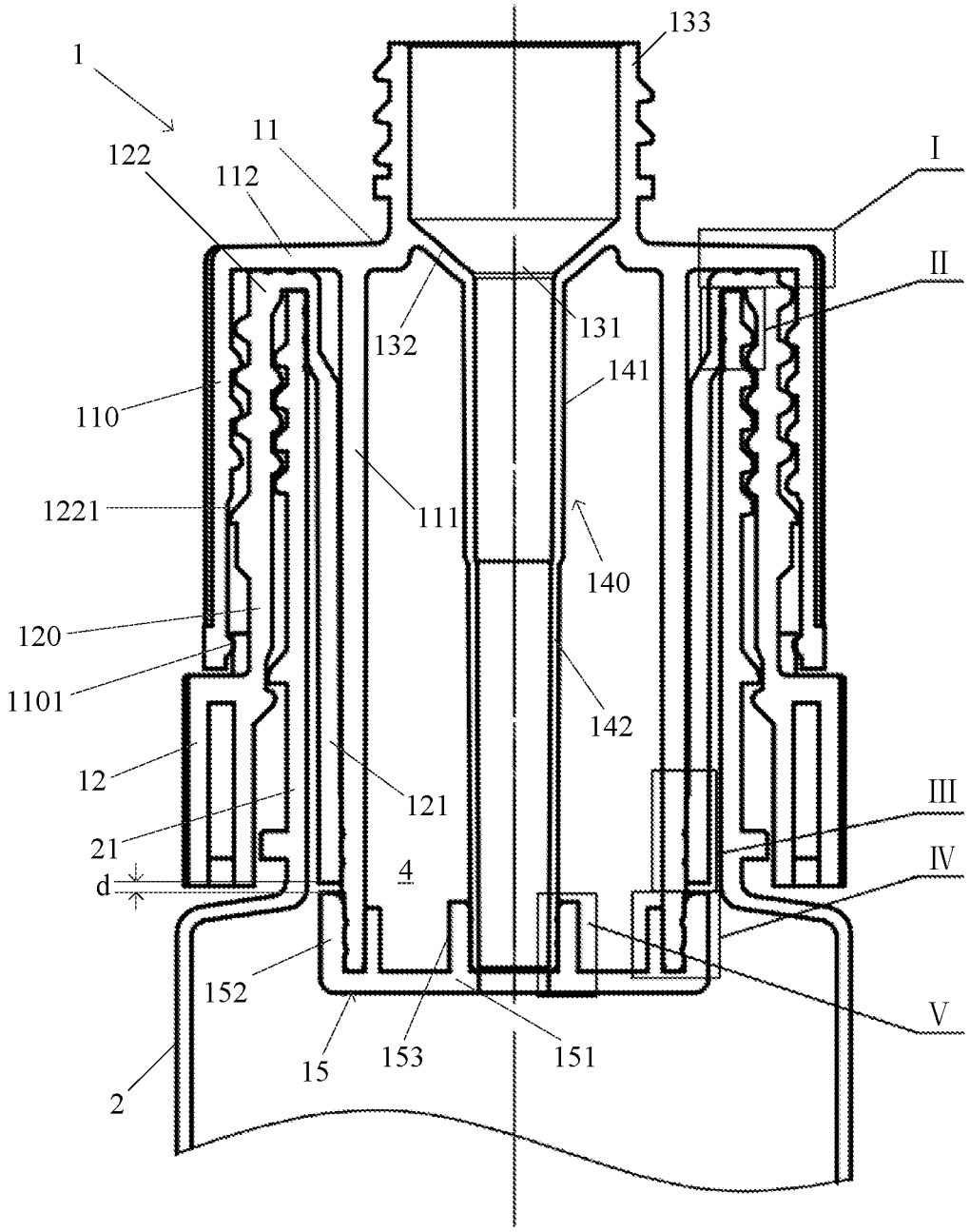
FIG. 1 is a half sectional view of the bottle according to one embodiment of this disclosure.

Various embodiments or implementations implementing the subject technical solution are disclosed below. To simplify the disclosure, specific examples of elements and arrangements are described below. Of course, these are only examples, not to limit the protection scope of this disclosure. For example, that the first feature is formed on or above the second feature, subsequently recorded in the specification, may comprise embodiments in which the first and second features are formed by way of direct connection, and embodiments in which additional features are formed between the first and second features so that there may be no direct connection between the first and second features. In addition, reference numerals and/or letters may be repeated in different examples in these disclosed. The repetition is intended to be brief and clear, not representing in itself a relationship between the embodiments and/or structures to be discussed. Furthermore, when a first element is described in a way of connecting or combining with a second element, the description comprises embodiments in which the first and second elements are directly connected or combined with each other, and also comprises that one or more other intervening elements are added to indirectly connect or combine the first and second elements with each other.

As shown in FIG. 1, the bottle according to this disclosure comprises a bottle body 2 and a bottle cap device 1. The bottle cap device 1 comprises an inner cap 12 and an outer cap 11. A first product, such as liquid-form medicine, can be stored in the bottle body 2. A second product, such as a solid medicine, can be stored in the bottle cap device 1. According to the operation method described later, the second product can be put into the bottle body 2 after the bottle cap device 1 is opened through a simple operation, and then mixed with the first product in the bottle body 2.

The inner cap 12 comprises an inner-cap outer ring 120 and an inner-cap inner ring 121, and a joint connected with the bottle neck 21 of the bottle body 2 is defined between the inner-cap outer ring 120 and the inner-cap inner ring 121.

The outer cap 11 comprises an outer-cap outer ring 110, an outer-cap inner ring 111 and a guide tube 140. In one embodiment, the inner cap 12, the outer cap 11 and the bottle body 2 are revolved bodies, but are not limited to this. For example, other structures can be constructed on the outer side of the outer cap 11 or the bottle body 2 as needed.

The outer-cap outer ring 110 is threadedly connected with the inner-cap outer ring 120. The outer-cap inner ring 111 penetrates through the inner-cap inner ring 121. The lower end of the inner-cap inner ring 121 protrudes for a distance, shown in FIG. 1, from the lower end of the inner-cap outer ring 120.

The guide tube 140 is arranged to extend in the outer-cap inner ring 111, providing a guide passage of liquid pipe not shown in the figures. The liquid pipe communicates a pump and the in-bottle space, conveying the mixed products in the in-bottle space outward through the pump. One embodiment of the pump is a press-type spray head.

The end cap 15 has an end-cap hole defined by a surrounding wall 153 at its center. In combination with FIG. 1, the distance, for which the lower end of the outer-cap inner ring 111 protrudes from the lower end of the inner-cap inner ring 121, is sufficient to allow the end cap 15 to be connected with the lower end of the outer-cap inner ring 111 in a releasably sealing manner. Moreover, when the outer-cap outer ring 110 rotates from the inner-cap outer ring 120 toward the loosening direction, the outer-cap outer ring 110 will move upward relative to the inner-cap outer ring 120, that is, the outer cap 11 will move upward, so the distance will be shortened, which will drive the end cap 15 to move upward such that the end cap 15 abuts with the lower end of the inner-cap inner ring 121, and the end cap 15 is released from the lower end of the outer-cap inner ring 111 by means of the thrust formed by the abutting.

While the end cap 15 is connected with the lower end of the inner-cap inner ring 121 in a releasably sealing manner, the guide tube 140 is connected with the end-cap hole in a sealing manner, thus forming a stockage space 4 encircling the guide tube 140 in the outer-cap inner ring 111. The stockage space 4 is used to store the second product.

When the end cap 15 is released from the lower end of the outer-cap inner ring 111, the end cap 15 falls into the bottle body 2, and then the second product is also put into the bottle body 2 to mix with the first product in the bottle body 2. The stockage space has no relation with the size of the pump body, which can be designed according to the size of the space required for the second product. By turning the outer cap 11, the bottle cap device can be opened, so that the second product can be put into the bottle body 2. The opening operation can be carried out by means of turning, and this operation way is simple and natural. Through sealing of the outer-cap inner ring and the end cap, and sealing of the end cap and the guide tube, the sealing preservation of the second product can be realized. Even the first product may move to the position of the end cap 15 during transportation, mixing of the first product and the second product at unexpected times will not occur.

On the basis of the preceding embodiments, the bottle cap device according to this disclosure can also have further embodiments.

Figure 3:
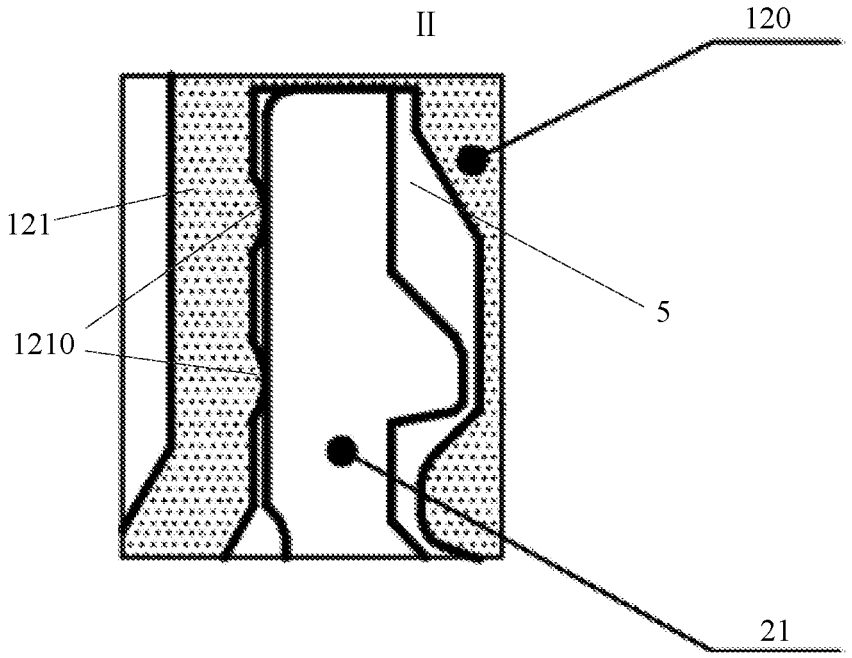
FIG. 3 is a partially enlarged view at II in FIG. 1.

In one embodiment, the inner cap is configured to comprise an inner-cap end wall 122 connecting the inner-cap outer ring 120 with the inner-cap inner ring 121, the inner-cap outer ring 120 encircles the inner-cap inner ring 121 and is spaced apart from the inner-cap inner ring 121 by an inner-cap annular gap 5, which can be understood with reference to FIG. 3. As shown in FIG. 1, the lower end of the inner-cap inner ring 121 protrudes downward with respect to the inner-cap outer ring 120. The inner-cap annular gap 5 provides a space for inserting the bottle neck 21. Internal thread for connecting the bottle neck 21 is formed on an inner wall surface of the inner-cap outer ring 120, and external thread is formed on an outer wall surface of the inner-cap outer ring 120, while internal thread is formed on an inner wall surface of the outer-cap outer ring 110, so that the outer-cap outer ring 110 is threadedly connected with the outer wall surface of the inner-cap outer ring 120. At the upper end portion, the inner-cap inner ring 121 and the outer-cap inner ring 120 are connected by the inner-cap end wall 122, which can have a function of forming a whole structure on one hand and can provide a deeper inner-cap annular gap 5 on the other hand. The inner-cap outer ring 120 is threadedly connected with the bottle neck 21, and the outer wall surface of the inner-cap outer ring 120 is threadedly connected with the inner wall surface of the outer-cap outer ring 110, making the structure of the two connections easy to implement. In the recommended embodiment, the locations of the two connections are further connected by a safety loop tape, to avoid accidental opening of the bottle cap or to avoid accidental twisting of the outer cap.

Still referring to FIG. 1, the outer cap is configured with an outer-cap end wall 112 connecting the outer-cap outer ring 110 with the outer-cap inner ring 111. The outer-cap outer ring 110 encircles the outer-cap inner ring 111 and is spaced apart from the outer-cap inner ring 111 by an outer-cap annular gap 6, which can be understood with reference to figures. The outer-cap annular gap 6 provides a space for inserting the inner-cap outer ring 120, and the guide tube 140 runs from the perforation 131 of the outer-cap end wall 112 and extends downward. The outer-cap end wall 112 connects the outer-cap outer ring 110 and the outer-cap inner ring 111 at the upper end of the outer cap, and the guide tube 140 extends downward out of the perforation 131 of the outer-cap end wall 112. Although adding the guide tube 140 is slightly complicated in manufacturing process compared with the structure without the guide tube, through the aforementioned design, the outer cap 11 can be obtained through general injection molding process when the outer cap is made of plastic such as polypropylene (PP).

In the embodiment shown in FIG. 1, the outer-cap end wall 112 provides a nozzle coupling 133 on the side thereof opposite to the outer-cap outer ring 110 and the outer-cap inner ring 111. The bottle cap device can be defined to also comprise a pump such as a press-type spray head, that is, the pump is also packaged together as a commercial product of the bottle cap device. The pump such as the press-type spray head is connected with the nozzle coupling, and the press-type spray head has a liquid pipe, and the liquid pipe is guided by the guide tube 140 and penetrates through the guide tube 140. It can be accordingly understood that when consumers use the product in the bottle, the mixture can be sprayed out by turning the outer cap and then performing pressing operation, which is especially convenient for patients when the product is medicine.

As shown in FIG. 1, the outer-cap end wall 112 forms a cone wall 132 around the perforation, and the cone wall 132 is configured to guide the liquid pipe to enter the guide part of the guide tube 140 from the perforation 131. This arrangement facilitates the assembly of the bottle according to this disclosure through an automatic production line. When the liquid pipe is inserted into the nozzle coupling 133 by an automatic component, the corresponding assembly can be completed without accurately aligning the liquid pipe with the perforation 131.

Figure 6:
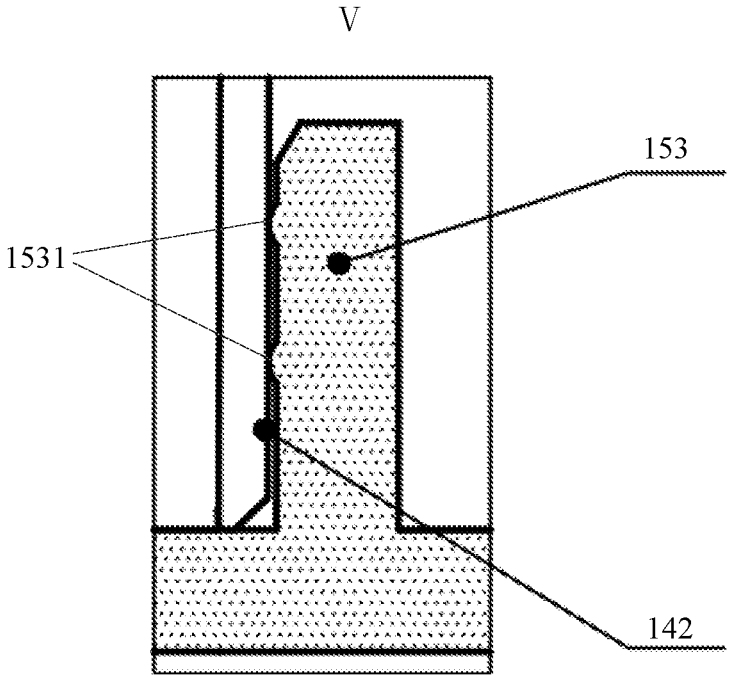
FIG. 6 is a partially enlarged view at V in FIG. 1.

As shown in FIG. 6, the hole wall of the end-cap hole defined by the surrounding wall 153 has at least one circle of rib 1531, and the rib 1531 contacts with the outer wall surface of the guide tube 140 to form a sealing structure. With regard to this sealing structure, when the end cap 15 is buckled at the lower end of the outer-cap inner ring, the guide tube 140 is inserted into the end-cap hole, and then the corresponding sealing structure is directly formed, which can simplify the assembly and facilitate the automation of the assembly.

In addition, in an embodiment not shown in the figures, the lower-end nozzle of the guide tube 140 is closed by a sheet, and a fracture line is arranged on the sheet. The advantage to do this is, when the liquid pipe of the pump is not inserted into the bottle, the first product in the bottle can be prevented from leaking through the guide pipe during assembly or other processes. Due to the existence of the fracture line, the liquid pipe can break through the blocking of the sheet after inserted into the guide tube 140.

Figure 2:
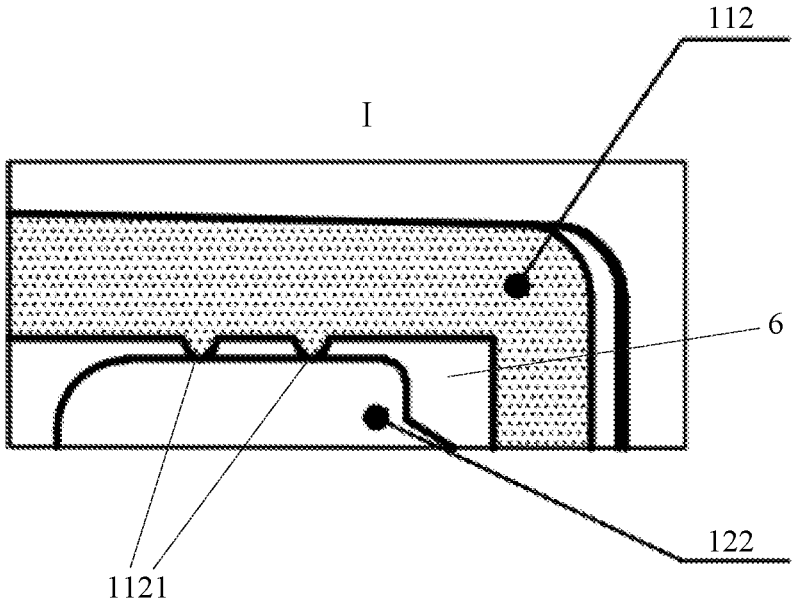
FIG. 2 is a partially enlarged view at I in FIG. 1.

In terms of improving the sealing performance of the product, the aforementioned embodiment can be further optimized. In one embodiment, as shown in FIG. 2, the inner-cap end wall 122 and the outer-cap end wall 112 have opposing end surfaces, and at least one of the opposing end surfaces is arranged with at least one circle of sealing convex ring 1121 which contacts the other of the opposing end surfaces, to form a sealing structure. The pressure required for sealing can be achieved by the tightening force generated when screwing.

As shown in FIG. 3, the inner-cap inner ring 121 is arranged with at least one circle of sealing convex ring 1210 on the outer wall surface corresponding to the inner-cap annular gap 5. The sealing convex ring 1210 is used to contact with the inner peripheral surface of the bottle neck 21, to form a sealing structure.

Figure 4:
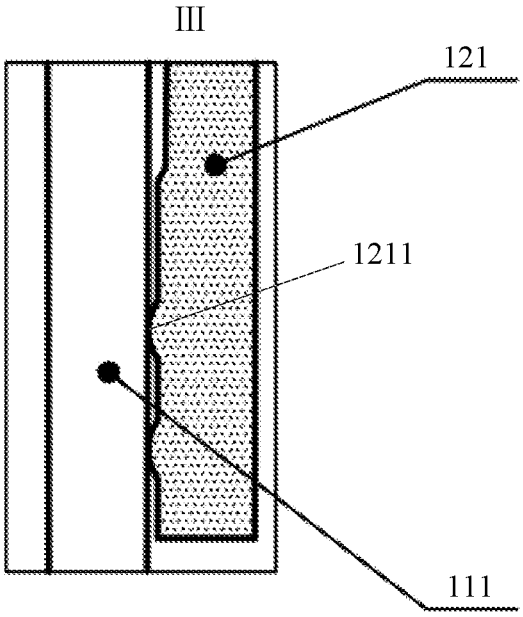
FIG. 4 is a partially enlarged view at III in FIG. 1.

As shown in FIG. 4, at least one of opposing wall surfaces between the inner-cap inner ring 121 and the outer-cap inner ring 111 is arranged with at least one circle of sealing convex ring 1211 which contacts the other of the opposing wall surfaces, to form a sealing structure.

Figure 5:
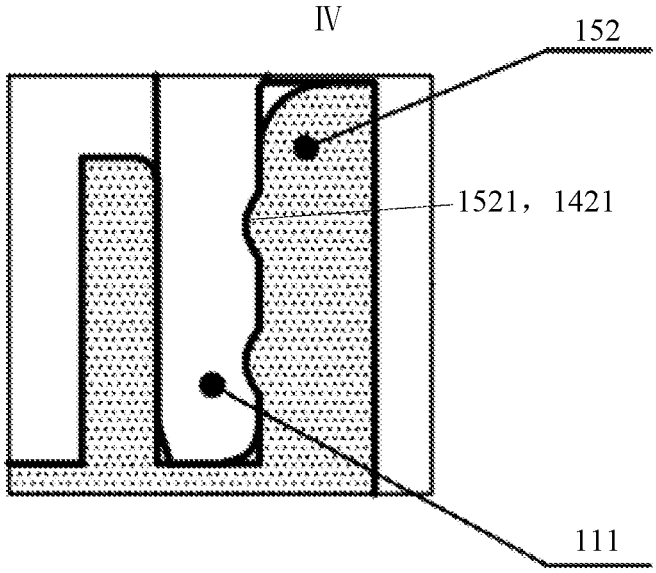
FIG. 5 is a partially enlarged view at IV in FIG. 1.

As shown in FIG. 1 and FIG. 5, the end cap 15 has an end-cap outer peripheral wall 152. One, of an inner wall surface of the end-cap outer peripheral wall 152 and a lower-end outer wall surface of the outer-cap inner ring 111, is formed with an annular rib 1521, while the other is formed with an annular groove 1421. The end cap 15 is releasably connected at a lower end of the outer-cap inner ring 111 by means of buckling of the annular rib 1521 and the annular groove 1421, and the annular rib 1521 is mated with the annular groove 1421, to form a sealing structure.

In addition, considering the requirements of forming process, the guide pipe 140 is preferably divided into two sections, the upper section 141 and the lower section 142, and the wall thickness of the upper section 141 is larger than that of the lower section 142.

Moreover, as shown in FIG. 1, one circle of outer-cap baffle ring 1101 is arranged on a lower-end inner wall of the outer-cap outer ring 110, and one circle of inner-cap baffle ring 1221 is arranged at a lower end of the threaded portion of the inner-cap outer ring 122. The inner-cap baffle ring 1221 can provide blocking function to the movement of the outer-cap baffle ring 1101. Therefore, when the threaded connection between the outer cap and the inner cap is completely loosened, it can prevent the outer cap disengage from the inner cap by the interaction between the inner-cap baffle ring 1221 and the outer-cap baffle ring 1101.

One still optional arrangement is, as shown in FIG. 1, a gap d is formed between a lower end surface of the inner-cap inner ring 121 and an upper end surface of the end-cap outer peripheral wall 152 of the end cap 15. The advantage of arranging the gap d is to facilitate that the end cap 15 is fully fastened to the lower end of the outer-cap inner ring 111.

This disclosure has been disclosed as above in the preferred embodiments, but it is not intended to limit this disclosure, and any possible changes and modifications may be made by the skilled in the art without departing from the spirit and scope of this disclosure. Therefore, any modification, equivalent variations, and embellishments to the above implements, without departing from the content of the technical solution of this disclosure or in accordance with the technical essence of this disclosure, are all incorporated in the protection scope defined in the claims of this disclosure.

What is claimed is:

1. A bottle cap device, comprising:

an inner cap having an inner-cap outer ring and an inner-cap inner ring, a joint connected with a bottle neck being defined between the inner-cap outer ring and the inner-cap inner ring;

an outer cap having an outer-cap outer ring, an outer-cap inner ring and a guide tube, the outer-cap outer ring being threadedly connected with the inner-cap outer ring, the outer-cap inner ring penetrating through the inner-cap inner ring, a lower end of the outer-cap inner ring protruding a distance from a lower end of the inner-cap inner ring, and the guide tube being arranged to extend in the outer-cap inner ring, providing a guide passage of liquid pipe; and an end cap having an end-cap hole, where the distance is sufficient to allow the end cap to be connected with the lower end of the outer-cap inner ring in a releasably sealing manner, and when the outer-cap outer ring is turned from the inner-cap outer ring toward a loosening direction, the distance is sufficiently shortened to allow the end cap abutting with the lower end of the inner-cap inner ring, and by means of the thrust formed by the abutting, the end cap is made to release from the lower end of the outer-cap inner ring, while the end cap is connected with the lower end of the inner-cap inner ring in a releasably sealing manner, the guide tube is connected with the end-cap hole in a sealing manner, such that a stockage space encircling the guide tube is formed inside the outer-cap inner ring.

2. The bottle cap device of claim 1, wherein the inner cap further comprises an inner-cap end wall connecting the inner-cap outer ring with the inner-cap inner ring, the inner-cap outer ring encircles the inner-cap inner ring and is spaced apart from the inner-cap inner ring by an inner-cap annular gap, the lower end of the inner-cap inner ring protrudes downward with respect to the inner-cap outer ring, the inner-cap annular gap provides a space for inserting the bottle neck, an internal thread for connecting the bottle neck is formed on an inner wall surface of the inner-cap outer ring, and an external thread is formed on an outer wall surface of the inner-cap outer ring, an internal thread is formed on an inner wall surface of the outer-cap outer ring, so that the outer-cap outer ring is threadedly connected with the outer wall surface of the inner-cap outer ring.

3. The bottle cap device of claim 2, wherein the inner-cap inner ring is arranged with at least one circle of a sealing convex ring on an outer wall surface corresponding to the inner-cap annular gap, and the sealing convex ring is used to contact with an inner peripheral surface of the bottle neck, to form a sealing structure.

4. The bottle cap device of claim 1, wherein the outer cap further comprises an outer-cap end wall connecting the outer-cap outer ring with the outer-cap inner ring, the outer-cap outer ring encircles the outer-cap inner ring and is spaced apart from the outer-cap inner ring by an outer-cap annular gap, the outer-cap annular gap provides a space for inserting the inner-cap outer ring, and the guide tube runs from a perforation of the outer-cap end wall and extends downward.

5. The bottle cap device of claim 4, wherein the outer-cap end wall provides a nozzle coupling on a side thereof opposite to the outer-cap outer ring and the outer-cap inner ring, and the bottle cap device further comprises a press-type spray head connected with the nozzle coupling, the press-type spray head has a liquid pipe, and the liquid pipe is guided by the guide tube and penetrates through the guide tube.

6. The bottle cap device of claim 5, wherein the outer-cap end wall forms a cone wall around the perforation, and the cone wall is configured to guide the liquid pipe to enter a guide part of the guide tube from the perforation.

7. The bottle cap device of claim 1, wherein on a hole wall of the end-cap hole there is at least one circle of rib, the rib contacts with an outer wall surface of the guide tube to form a sealing structure, a lower-end nozzle of the guide tube is closed by a sheet, and a fracture line is arranged on the sheet.

8. The bottle cap device of claim 1, wherein the inner cap further comprises an inner-cap end wall connecting the inner-cap outer ring and the inner-cap inner ring, the outer cap further comprises an outer-cap end wall connecting the outer-cap outer ring and the outer-cap inner ring, the inner-cap end wall and the outer-cap end wall have opposing end surfaces, at least one of the opposing end surfaces is arranged with at least one circle of sealing convex ring which contacts the other of the opposing end surfaces, to form a sealing structure, at least one of opposing wall surfaces between the inner-cap inner ring and the outer-cap inner ring is arranged with at least one circle of sealing convex ring which contacts the other of the opposing wall surfaces, to form a sealing structure.

9. The bottle cap device of claim 1, wherein the end cap has an end-cap outer peripheral wall, one of an inner wall surface of the end-cap outer peripheral wall and a lower-end outer wall surface of the outer-cap inner ring is formed with an annular rib, while the other is formed with an annular groove, and the end cap is releasably connected at a lower end of the outer-cap inner ring by means of buckling of the annular rib and the annular groove, and the annular rib is mated with the annular groove to form a sealing structure;

a gap is formed between a lower end surface of the inner-cap inner ring and an upper end surface of the end-cap outer peripheral wall of the end cap;

an outer-cap baffle ring is arranged on an inner wall of the outer-cap outer ring; and an inner-cap baffle ring is arranged on an outer wall surface of the inner-cap outer ring, and when threaded connection is completely loosened, the inner-cap baffle ring is used to provide a blocking function to movement of the outer-cap baffle ring.

10. The bottle cap device of claim 1, wherein the bottle further comprises a bottle cap device and a bottle body, the bottle cap device is connected with a bottle neck of the bottle body, the bottle body stores a first product, and the bottle cap device stores a second product.

* * * * *